US005490570A

United States Patent [19]

Millsapps, Jr.

[11] Patent Number: 5,490,570

[45] Date of Patent: Feb. 13, 1996

[54] EARTH BORING BIT AND LUBRICATOR/COMPENSATOR THEREFOR

[75] Inventor: Stuart C. Millsapps, Jr., Austin, Tex.

[73] Assignee: Briscoe Tool Company, Houston, Tex.

[21] Appl. No.: 347,823

[22] Filed: Dec. 1, 1994

[51] Int. Cl.[6] ..... E21B 10/24

[52] U.S. Cl. ..... 175/228

[58] Field of Search ..... 175/228, 227, 175/371; 384/93

[56] References Cited

U.S. PATENT DOCUMENTS

| | | | |
|---|---|---|---|
| 3,942,596 | 3/1976 | Millsapps, Jr. | 175/227 |
| 4,161,223 | 7/1979 | Oelke | 175/228 |
| 4,199,856 | 4/1980 | Farrow et al. | 384/93 X |
| 4,386,667 | 6/1983 | Millsappas, Jr. | 175/228 |
| 4,388,984 | 6/1983 | Oelke | 175/228 X |
| 4,552,228 | 11/1985 | Evans et al. | 175/228 |
| 4,865,136 | 9/1989 | White | 175/227 |
| 4,942,930 | 7/1990 | Millsapps, Jr. | 175/228 |
| 5,027,911 | 7/1991 | Dysart | 175/57 |
| 5,072,795 | 12/1991 | Delgado et al. | 175/228 |

OTHER PUBLICATIONS

Catalog excerpts from Reed Tool Company, 2 pages.
Catalog excerpts from Walker–McDonald, 3 pages.

*Primary Examiner*—Hoang C. Dang
*Attorney, Agent, or Firm*—Browning, Bushman, Anderson & Brookhart

[57] ABSTRACT

An improved pressure compensator of the top-vented type for a roller cone drill bit comprises an elastomeric compensator diaphragm having an annular, peripheral, radially outwardly extending flange. An annular, axially acting compression spring is at least partially imbedded in the flange, elastomeric material of the flange at least partially underlying and overlying the spring for sealing engagement, respectively, with an axially facing shoulder in a recess in the bit body and a cap forming part of the assembly. The cap is disposed above the flange in the bit recess, and has a lower end surface for sealing abutment with the flange. The cap also has a vent communicating a zone above the diaphragm, in the recess, with the exterior of the bit. A retainer is positioned to hold the cap in the recess, thereby also retaining the diaphragm in the recess, and compressing the spring sufficiently to cause sealing engagement on both sides of the flange, but not beyond the elastic limit of the spring.

13 Claims, 2 Drawing Sheets

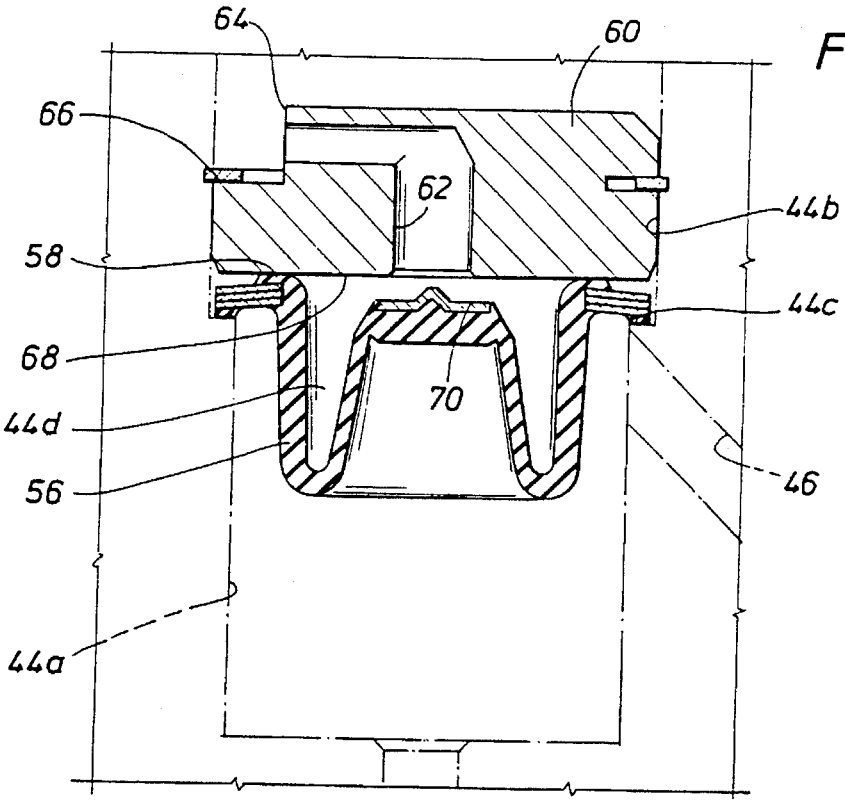
FIG. 2
FIG. 3
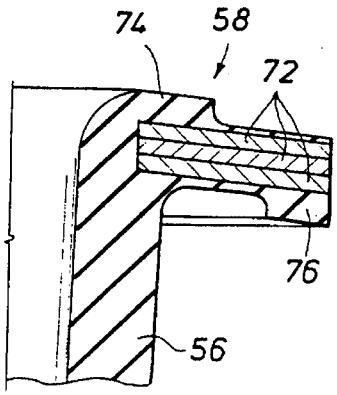
FIG. 4
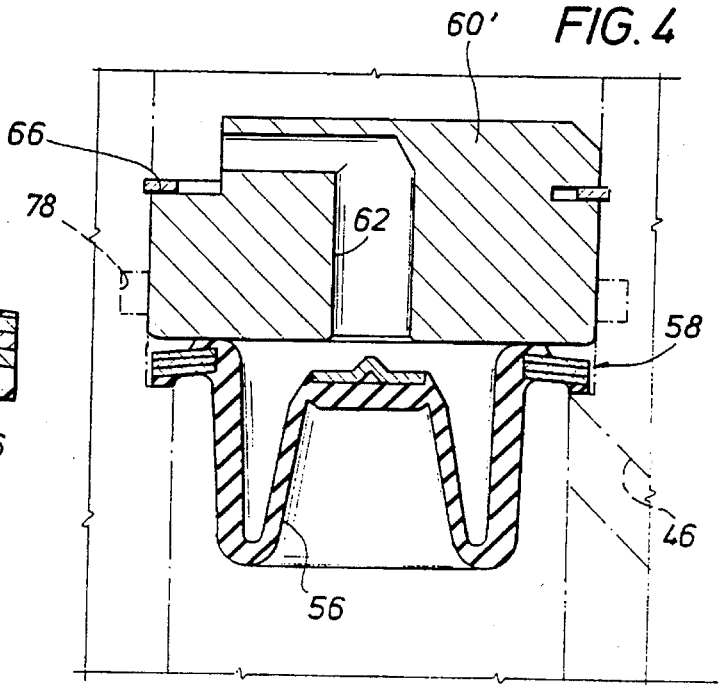

EARTH BORING BIT AND LUBRICATOR/COMPENSATOR THEREFOR

BACKGROUND

The present invention pertains to the type of well drilling bit commonly referred to as a "roller cone" bit or "rock" bit. Such a bit typically includes a main bit body which is attached to and rotates with the drill string. The bit body includes a centralized portion, which has the joint for attachment to the drill string at one end, and also includes a plurality of radially and circumferentially spaced legs depending longitudinally from the other end of the centralized portion. A rolling cutter body or "cone" is rotatably mounted on the free end of each of these legs. Thus, as the bit body is rotated by the drill string, these cones are caused to roll along the bottom of the hole being drilled, and teeth on the cones disintegrate the earth formation.

Rotary bearings are provided between the cones and their respective legs, and these bearings must be lubricated. An annular seal is provided at the free or open end of the bearing interface between the cone and the bit leg in order to keep the lubricant in the bearing and exclude well fluids, and the abrasives they carry, from the bearing. It is very important that the integrity of these bearing seals be maintained. If it is not, the bearing can be ruined. This not only makes repair difficult and expensive, if not impossible, but drilling must be temporarily stopped, and the drill string tripped to replace the bit, an extremely expensive operation.

Accordingly, such bits are typically provided with a respective lubricant reservoir recess for each cone, and in this recess is disposed a mechanism which contains a supply of lubricant, which can be urged toward the bearing through an interconnecting lubricant passage, to keep the bearing supplied and replace any lubricant which is lost; the mechanism also includes a flexible, preferably elastomeric, pressure compensator such as an elastomeric diaphragm, one side of which is exposed to the lubricant pressure, and the other side of which is exposed to the pressure external to the bit in the borehole. The compensator can react to increases in external pressure, so as to ensure that the lubricant pressure is equal thereto, and prevent leakage of drilling fluid into the bearing. Conversely, it can react to decreases in well pressure to reduce the pressure it is exerting on the lubricant, to prevent diaphragm damage, lubricant waste, and/or displacement of or damage to the bearing seal.

There are two basic types of such mechanisms known in the art, distinguished by whether the vent port for exposing the diaphragm to the external borehole pressure opens generally upwardly through the outer part of the bit body, or downwardly, through the shroud of the bit body.

Examples of so called "top vented" pressure compensators are shown in U.S. Pat. No. 3,942,596 as well as in the commercial literature of assignee New Tech Rock Bit Co., and of Reed, Walker McDonald, and Rock Bit International, filed herewith. An advantage of the top vented lubricator/compensator mechanism is that it is relatively simple in terms of the number and nature of parts, especially seals, required. In the hostile downhole environment, it is generally the case that, the simpler a mechanism can be, and more particularly the fewer its parts, the less vulnerability to damage, deterioration by well fluids and/or abrasives therein, damage from temperature and pressure conditions, etc.

There is, however, room for even further simplification. For example, in the system shown in Assignee's commercial literature, filed herewith, the compensator proper, i.e. the diaphragm and a metal ring bonded thereto, are held in place by a cap, in turn releasably retained by a snap ring. The cap defines the vent porting. As can be seen in the illustration, the cap must be hollowed out in order to form a lowermost cylindrical projection which can fit over a portion of the aforementioned ring to abut a lower flange thereof for retention purposes, and also to seal against an O-ring carried in a groove formed in the O.D. of the ring. The bit body must also be machined to form a groove for holding an O-ring which seals against the outer surface of the cylindrical projection on the cap. Furthermore, the cap must be relatively long in order to provide this projection, which may affect the position, and thus the available size, of the lubricant reservoir space available for storing grease.

SUMMARY OF THE INVENTION

The present invention seeks to provide an even simpler form of top-vented lubricating and pressure compensating mechanism. The features of the present invention allow for greater simplicity not only in the cap, but also in the compensator proper. These features may also provide for greater simplicity, i.e. less machining, in the bit body, as well as more lubricant storage space; alternatively, the parts of the invention may be sized so that the improved lubricator/compensator can be retrofitted into existing bit bodies having the aforementioned O-ring groove, without utilizing that groove for sealing purposes, but also without adversely affecting the operation of the simplified lubricating mechanism.

More particularly, the lubricating/compensator mechanism includes a compensator proper or diaphragm, which is elastomeric, and extends generally laterally across the respective recess in the bit body in which the mechanism is installed, dividing this recess into a lower zone communicating with the respective lubricant passage to the roller cone bearing, and otherwise closed, and an upper zone including an open mouth of the recess. The mechanism also includes a cap disposed above the diaphragm in the recess for releasably retaining the diaphragm in the recess and defining a vent communicating the upper zone of the recess with the exterior of the bit body. First seal means seal the diaphragm to the bit body in a generally axial direction with respect to the recess, and second seal means seal the diaphragm to the cap, also in a generally axial direction.

In a preferred embodiment, the diaphragm includes an annular, peripheral, radially outwardly projecting flange. The first seal means is cooperative between an underside of this flange and a generally upwardly facing shoulder in the recess, while the second seal means is cooperative between an upper side of this flange and a lower, axially facing end surface of the cap.

Even more preferably, the under and upper sides of the flange are adapted to serve as the first and second seal means, respectively. The flange preferably has at least one annular, axially acting, compression spring therein and includes elastomeric portions of the flange underlying and overlying the spring to form the seal means. The spring may preferably be of the Bellville type, and there may be a plurality of such springs stacked within the flange.

It can be appreciated that, with the above arrangement, the need for two separate, radially acting, O-ring seals, and respective groove-forming means to carry them, is eliminated. In the preferred embodiment, the seals are integrally formed on the flange of the diaphragm itself, and the spring or springs imbedded in the flange helps to urge the sealing material on the upper and under sides of the flange into tight engagement with the respective opposed surfaces when the cap is properly positioned to compress the spring, but not beyond its elastic limit.

Another advantage of this arrangement is that the force with which the spring is compressed may be chosen so that, in the event of pressure in excess of a chosen amount building up in the lower zone of the recess, this pressure can further compress the spring, thereby lifting the flange off the shoulder in the recess and allowing this excess pressure to vent so that the diaphragm is not damaged.

Not only are the parts of the compensator and the machining of the recess in the bit body simplified, but, instead of bonding the diaphragm to a customized O-ring-retaining ring as in the prior art, the diaphragm is merely bonded to one or more Bellville springs, which can be off the shelf items, with little or no modification, depending upon the desired size of the compensator. This further reduces the overall expense of the system.

If it is desired to retrofit existing bit bodies with such an improved lubricating/compensator mechanism, it is merely necessary to size the cap so as to dispose the sealing flange below the annular groove in the recess wall which previously contained an O-ring. This sizing can also be used where it is desired to form new bit bodies so they can alternatively use a mechanism according to the present invention, or one according to the prior art.

On the other hand, new bit bodies made for exclusive use with the mechanism of the present invention may not only be simplified by elimination of the O-ring groove, but may then have their compensator caps made thinner, which in turn ultimately allows more space for grease in the lubricant reservoir.

The present invention comprises a complete bit, incorporating the mechanism described above, as well as the sub assembly of the mechanism per se.

Various objects, features, and advantages of the invention will be further elaborated by the following description, the drawings, and the claims.

BRIEF DESCRIPTION OF THE DRAWING

FIG. 2 is an enlarged longitudinal cross-sectional view of the lubricating/compensator mechanism shown in the bit of FIG. 1.

FIG. 3 is an enlarged detailed cross-sectional view of the diaphragm flange.

FIG. 4 is a view similar to that of FIG. 2 showing another embodiment of lubricating/compensator mechanism and adjacent parts of the bit body.

DETAILED DESCRIPTION

Figure 1:
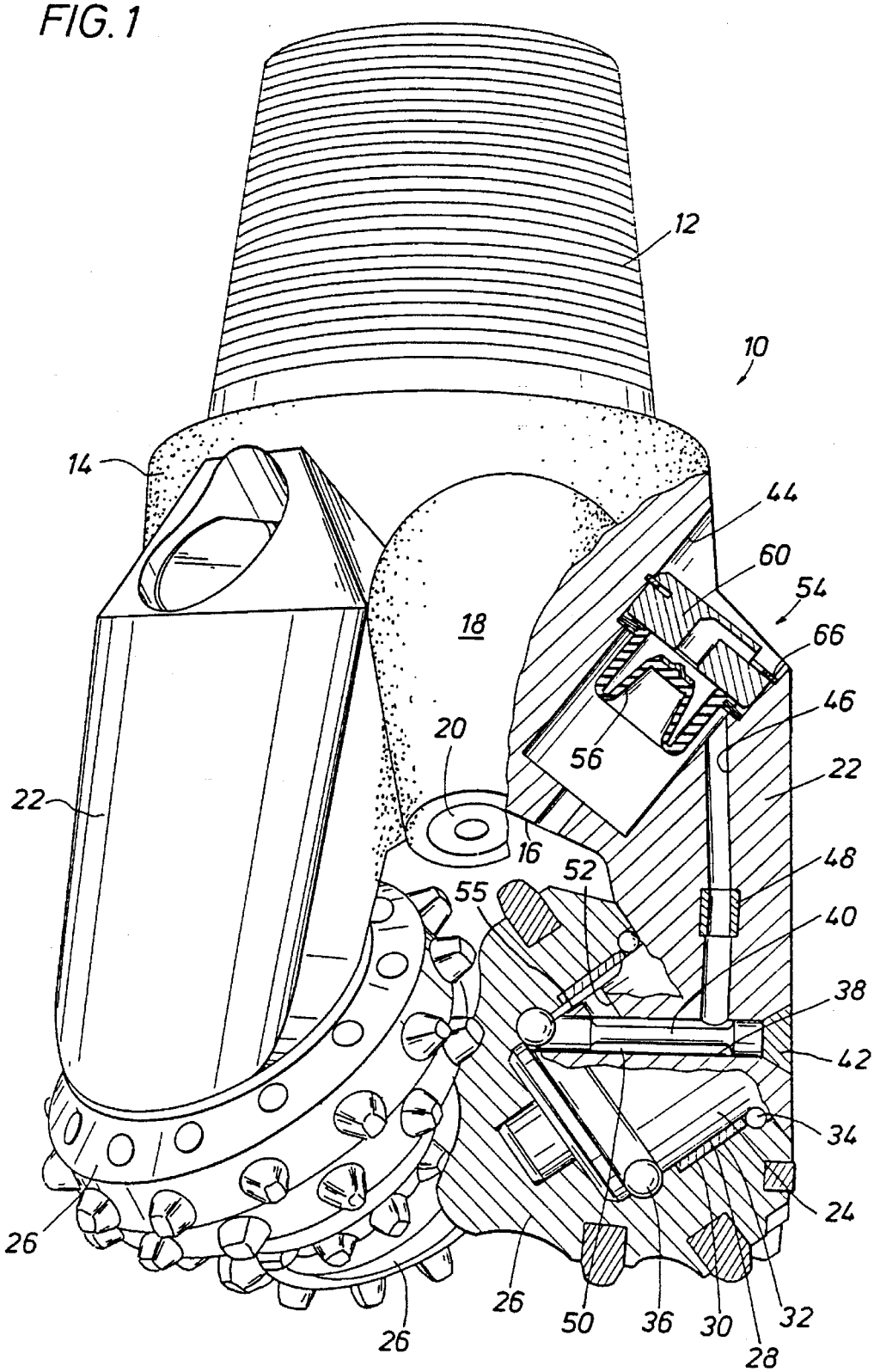
FIG. 1 is a side elevational view of a bit in accord with one embodiment of the present invention with one bit leg and associated parts being shown in longitudinal cross-section.

FIG. 1 shows a well drilling bit according to a first embodiment of the present invention. The bit includes a bit body 10 which is shown in the position it would assume in use in a vertical hole. Terms such as "upper" and "lower" are used herein for convenience with reference to this traditional position, and are not intended to be limiting, e.g. if the bit is used in horizontal drilling or is placed in a different position for purposes of manufacture or repair. Also, unless otherwise indicated, such terms are used in a general sense, e.g. a port may be "upwardly opening" if it is disposed at an angle with a significant vertically upward component.

The bit body includes a centralized portion including an uppermost threaded pin 12 for connecting the bit to the lowermost drill pipe, collar or other member in a drill string. Below pin 12, the centralized portion of the bit body has an enlarged part 14. The underside of this enlarged part 14 is referred to as the shroud 16 of the bit. As well known in the art, a large central bore (not shown) extends downwardly through pin 12 and into part 14, where it branches into a plurality (typically three) of passages (also not shown), each of which extends through an enlarged nozzle mounting portion of the bit body, one of which is shown at 18. In the bottom of each nozzle mounting portion, there is mounted a nozzle 20. Drilling fluid is typically pumped downwardly through the passages in the centralized portion of the bit body, and out through the nozzles 20 to cool the cutters (to be described below) and flush cuttings away from the cutters and back up through the annulus of the well.

In addition to the centralized portion 12, 14, bit body 10 includes a plurality (typically three) of legs depending downwardly from the centralized portion in radially and circumferentially spaced relation to one another. For clarity of illustration, only 2 such legs 22 are shown in FIG. 1. The lowermost portion of each leg 22 is inclined radially inwardly and downwardly, and suitably machined, to form a trunnion 24.

A respective cutter or cone 26 is mounted on each trunnion 24. The hollow interior of the cone is formed to cooperate with the specific form of the trunnion. More specifically, the trunnion 24 has, near its upper end, a relatively large cylindrical section 28 which is surrounded by a journal bearing 30, cooperative between cylindrical section 28 and a corresponding cylindrical section 32 of the interior of cone 26. Upwardly of the cylindrical sections 28 and 32, the trunnion and cone are adapted to receive an annular bearing seal 34, which may be an elastomeric O-ring, as shown. Below cylindrical sections 28 and 32, the trunnion and cone have opposed arcuate grooves which, together, form a ball race for receiving a set of balls 36. The balls are inserted through a bore 38, after which a relieved pin 40 is inserted into the bore 38 and retained by a plug weld 42. Thus, the balls retain the cone 26 on the trunnion 24, and also may provide further rotary and inward thrust bearing functions.

The centralized portion of the bit body 10 has three upwardly opening lubricant reservoir recesses 44, each of which is located just above one of the legs 22. A lubricant passage in the form of a bore 46 extends downwardly through a respective one of the legs 22, interconnecting the respective reservoir 44 with the respective bore 40. (The small sleeve 48 is formed from a dowel used in certain manufacturing techniques wherein the leg is formed of two parts welded together along a generally transverse interface. The dowel is later drilled out to form sleeve 48.) By means to be described more fully below, lubricant in the reservoir 44 is urged into and through passage 46 whence it can enter the relieved area 50 of pin 40, and pass along that pin into the ball race, as well as through a lateral port 52 which interconnects the bore 38 with the journal bearing area. To assist in the distribution of lubricant about the journal bearing formed by opposed surfaces of the cylindrical section 28 of the trunnion and the bearing sleeve 30, the former may have a lengthwise relief groove 55 of limited circumferential extent.

Referring now jointly to FIGS. 1 and 2, an exemplary one of the combination lubricating/compensator mechanisms 54, each of which is disposed in a respective reservoir 44 will be described.

The mechanism 54 includes an elastomeric compensator diaphragm 56 which extends generally laterally across the recess 44. That is to say, although the diaphragm 56 is convoluted, and therefore includes primarily longitudinally extending sections, overall it extends across the recess and divides it into a lower zone 44*a* communicating with the lubricant passage 46 and otherwise closed, and an upper zone 44*b* including the open mouth of the recess through which the mechanism 54 is installed. It is noted that the upper section 44*b* is counterbored to form an upwardly facing shoulder 44*c* at the juncture of the upper and lower zones. The diaphragm 56 includes an annular, peripheral, radially outwardly projecting flange 58 sized to rest on the shoulder 44*c*.

The mechanism 54 also includes a cap 60 disposed above the diaphragm 56 in the upper zone 44*b* of the recess 44. Cap 60 has a vent passage 62 opening axially into its underside, in communication with upper zone 44*b*, and extending thence upwardly and then radially to open out through a cutaway portion 64 in its upper part and thereby communicate with the exterior of the bit. It should be noted that, while the shoulder 44*c* generally defines the juncture of the upper and lower zones of the recess 44, the zones are specifically defined by the diaphragm 56: the space above the diaphragm 56 is considered part of the upper zone 44*b*, while the space below the diaphragm 56 is considered the lower zone 44*a*, and due to the convolutions of the diaphragm 56, and the fact that it may move in response to various pressure conditions, the exact shape and locus of the line of demarcation between the two zones can change from time to time, and more specifically, parts of the upper zone such as areas 44*d* may be located in alignment with the part of recess 44 below shoulder 44*c*.

The center portion of diaphragm 56 has a protective metal disc 70, with a central upward projection, bonded to its upper surface so that, in the event of high pressure in the lower portion 44*a* of the recess, the metal disc will be guided into engagement with the lower opening of passage 62, protecting the elastomeric diaphragm proper from possible damaging contact with the edge of that opening. As a further safeguard the edge of the opening may be beveled.

Cap 60 is releasably retained in recess 44 by a snap ring 66 cooperative between respective annular grooves in the cap 60 and the wall of the recess 44. Since the lower axially facing end surface 68 of the cap is sized to overly flange 58 in opposition to shoulder 44*c*, this in turn retains the diaphragm 56 in place.

Referring now to the detailed view of FIG. 3, it can more easily be seen that the flange 58 includes a stack of three identical Bellville springs 72 imbedded in and bonded to the elastomeric material of the diaphragm 56 such that that elastomeric material at least partially overlies and underlies the stack of springs. More specifically, the thick inner part 74 of the material overlying the flange may stop short of the outer peripheral edges of the springs 72, since this material will seal against the underside of cap 60, urged into tight engagement therewith by the radially inner portions of the springs 72.

The elastomeric material of flange 58 underlying springs 72 forms an outer, annular, downward projecting rim or "foot" 76 for sealing engagement with shoulder 44*c* under influence of the outer parts of springs 72.

In alternate embodiments, there may be a greater or lesser number of Bellville springs. In fact, in some embodiments, a single spring may suffice. It may also be possible to use other types of axially-acting compression springs.

In any event, the thickness of the cap 60 and the location of the snap ring 66 in recess 44 are chosen so that, when the mechanism is installed in the recess, the springs 72 will be compressed or preloaded, but not beyond their elastic limit. More specifically, this preloading can be chosen so as to predetermine an amount of pressure in the lower zone 44*a* of the recess which will lift the flange 58 upwardly off shoulder 44*c*, thereby venting excess pressure, and preventing damage to the diaphragm 56 and/or the respective bearing seal 34.

FIG. 4 shows how the mechanism can be modified to retrofit prior art bits in which the recess 44 has an O-ring groove 78 for holding a radially acting O-ring type seal. This embodiment could also be used where it is desired to build a bit body such that it can utilize either a compensator according to the present invention or one according to the prior art. The cap 60' is simply made thicker, in the longitudinal direction, so that both of the seals formed by flange 58 are disposed below groove 78 in the recess.

Numerous modifications of the preferred embodiments described above will suggest themselves to those of skill in the art. Accordingly, it is intended that the scope of the invention be limited only by the following claims.

I claim:

1. A well drilling bit comprising:

a bit body including a centralized portion and a plurality of radially and circumferentially spaced legs depending longitudinally from the centralized portion;

a respective cutter body rotatably mounted on the free end of each leg with bearing means cooperative between each leg and the respective cutter body;

wherein the bit body has a respective lubricant passage therethrough communicating with each bearing and with a generally upwardly opening lubricant reservoir recess in the bit body distal the respective bearing; and a respective lubricating mechanism in each lubricant reservoir recess, each lubricating mechanism comprising an elastomeric compensator diaphragm extending generally laterally across the respective recess and dividing the recess into a lower zone communicating with the respective lubricant passage and otherwise closed, and an upper zone including an open mouth of the recess, the diaphragm including an annular, peripheral, radially outwardly projecting flange having at least one annular, axially acting, compression spring therein and elastomeric material at least partially covering the spring;

a cap disposed above the diaphragm in the recess for releasably retaining the diaphragm in the recess with the spring at least slightly deflected, and defining a vent communicating the upper zone with the exterior of the bit body;

first seal means cooperative between an underside of the flange and a generally upwardly facing shoulder in the recess, sealing the diaphragm to the bit body in a generally axial direction with respect to the recess;

and second seal means cooperative between an upper side of the flange and a lower, axially facing end surface of the cap, sealing the diaphragm to the cap in a generally axial direction with respect to the recess.

2. The apparatus of claim 2 wherein the under and upper sides of the flange are adapted to serve as the first and second seal means, respectively.

3. The apparatus of claim 2 wherein the flange includes elastomeric portions underlying and overlying the spring to form the seal means.

4. The apparatus of claim 3 wherein the spring is of the Bellville type.

5. The apparatus of claim 4 comprising a plurality of such Bellville springs stacked within the flange.

6. The apparatus of claim 4 wherein the elastomeric portion of the flange underlying the spring has an annular, radially outer downward sealing projection.

7. The apparatus of claim 3 further comprising retainer means cooperative between the cap and the bit body to releasably retain the cap in the recess.

8. The apparatus of claim 7 wherein the retainer means is positioned to cause the cap to deflect the spring, but not beyond its elastic limit.

9. The apparatus of claim 7 wherein the recess has an annular groove in its wall above the shoulder, and the cap is sized and the retainer means positioned so as to dispose the flange below the annular groove.

10. A top-vented pressure compensator assembly for a roller-cone type drill bit comprising:

an elastomeric compensator diaphragm having an annular, peripheral, radially outwardly extending flange;

an annular, axially acting compression spring at least partially imbedded in the flange, elastomeric material of the flange at least partially underlying and overlying the spring;

a cap above the diaphragm for releasably retaining the diaphragm in a recess in a main body of the bit with the spring at least slightly deflected, having a vent passage generally vertically therethrough, and having a lower axially facing end surface abutting the upper side of the flange;

and retainer means for cooperation between the cap and the main body of the bit to releasably retain the cap in the bit recess.

11. The apparatus of claim 10 wherein the spring is of the Bellville type.

12. The apparatus of claim 11 comprising a plurality of such springs stacked within the flange.

13. The apparatus of claim 11 wherein the elastomeric portion of the flange underlying the spring has an annular, radially outer, downward sealing projection.

* * * * *

UNITED STATES PATENT AND TRADEMARK OFFICE

CERTIFICATE OF CORRECTION

PATENT NO. : 5,490,570

DATED : February 13, 1996

INVENTOR(S) : Stuart C. Millsapps, Jr.

It is certified that error appears in the above-indentified patent and that said Letters Patent is hereby corrected as shown below:

Column 6:

In claim 2, line 65, delete "2" and insert therefore --1--.

Signed and Sealed this

Thirtieth Day of April, 1996

*Attest:*

*Attesting Officer*

BRUCE LEHMAN

*Commissioner of Patents and Trademarks*